US012709852B2

(12) United States Patent
Rong et al.

(10) Patent No.: US 12,709,852 B2
(45) Date of Patent: Aug. 18, 2026

(54) STEP-BY-STEP PAIRED AND UP-DOWN RECIPROCATING COMBINED FISHWAY AND FISH PASSAGE METHOD

(71) Applicant: ANHUI UNIVERSITY OF SCIENCE & TECHNOLOGY, Huainan (CN)

(72) Inventors: Guiwen Rong, Huainan (CN); Huichao Dai, Huainan (CN); Hongling Jiang, Huainan (CN); Jinqiao Mao, Huainan (CN); Qimeng Liu, Huainan (CN); Shangzhi Chen, Huainan (CN); Tiegang Zheng, Huainan (CN); Junjun Tan, Huainan (CN); Baiqing Xiao, Huainan (CN); Shuzan Zhang, Huainan (CN); Xu Wang, Huainan (CN); Tian He, Huainan (CN)

(73) Assignee: ANHUI UNIVERSITY OF SCIENCE & TECHNOLOGY, Huainan (CN)

( * ) Notice: Subject to any disclaimer, the term of this patent is extended or adjusted under 35 U.S.C. 154(b) by 169 days.

(21) Appl. No.: 18/552,802

(22) PCT Filed: Mar. 7, 2023

(86) PCT No.: PCT/CN2023/080117
§ 371 (c)(1),
(2) Date: Sep. 27, 2023

(87) PCT Pub. No.: WO2023/169428
PCT Pub. Date: Sep. 14, 2023

(65) Prior Publication Data

US 2024/0183120 A1 Jun. 6, 2024

(30) Foreign Application Priority Data

Mar. 7, 2022 (CN) ..... 202210218010.7

(51) Int. Cl.
*E02B 8/08* (2006.01)

(52) U.S. Cl.
CPC ..... *E02B 8/085* (2013.01)

(58) Field of Classification Search
CPC ..... E02B 8/085; E02B 8/08
See application file for complete search history.

(56) References Cited

U.S. PATENT DOCUMENTS

2024/0110355 A1* 4/2024 Dai ..... E02B 8/085

FOREIGN PATENT DOCUMENTS

CN 104088260 * 10/2014

* cited by examiner

*Primary Examiner* — Sean D Andrish
(74) *Attorney, Agent, or Firm* — Maschoff Brennan

(57) ABSTRACT

A step-by-step paired and up-down reciprocating combined fishway and a fish passage method thereof, belonging to the technical field of fish passage facilities. The disclosure includes fishway units, a mechanical transmission system, a fish repelling system, a control system, and a recovery cableway. Under combined action of the mechanical transmission system and the fish repelling system, the fishway units reciprocate up and down step by step to form a fish passage way.

16 Claims, 4 Drawing Sheets

STEP-BY-STEP PAIRED AND UP-DOWN RECIPROCATING COMBINED FISHWAY AND FISH PASSAGE METHOD

CROSS-REFERENCE TO RELATED APPLICATIONS

This patent application claims priority to and is a 35 U.S.C. § 371 U.S. National Stage Application of International Patent Application PCT/CN2023/080117 filed on Mar. 7, 2023, which claims the benefit and priority of Chinese Patent Application No. 202210218010.7 filed with the China National Intellectual Property Administration on Mar. 7, 2022, the disclosure of which is incorporated by reference herein in its entirety as part of the present application.

TECHNICAL FIELD

The present disclosure relates to the technical field of fish passage facilities, in particular to a step-by-step paired and up-down reciprocating combined fishway.

BACKGROUND

Water conservancy and hydropower projects have a certain impact on the surrounding ecological environment. On the one hand, the construction of large-scale water conservancy and hydropower projects blocks the connectivity of rivers, resulting in changes in the original water level, flow velocity, flow rate and other hydrological factors in rivers; and on the other hand, the construction of the water conservancy and hydropower projects also has an impact on material circulation, information transmission, energy flow and so on in rivers, leading to changes in the habitats required for fish life activities, and delays and cessation of migratory activities such as spawning, feeding, and overwintering of fish. Fish passage facility is a facility that helps fish pass through river gate dams, and plays an important role in fish migration upstream. Fishway is a widely used fish passage facility, and is an ecological compensation measure to reduce the disturbance of gate dams on survival and reproduction of fish. Fishway is of great significance for decreasing the barrier effect of dams and helping to restore free migration of fish and other aquatic biological species in rivers.

At present, vertical slot fishway and natural-like fishway are dominant in China. According to the corresponding dam heights of the vertical slot fishway and the natural-like fishway, the dam height of the vertical slot fishway ranges from 6.0 m to 39.7 m, while the corresponding dam height of the natural-like fishway ranges from 6.0 m to 28.7 m. The vertical slot fishway corresponds to a wide range of dam height, and the length of the fishway is positively correlated with the dam height, that is, the higher the dam height is, the longer the fishway is, and the slope is reduced by increasing the length of the fishway, so as to meet the requirement of limiting the flow velocity. The flow velocity in the fishway is in a range of 0.5~1.7 m/s. The natural-like fishway also has a wide range of corresponding dam height, the depth of the fishway is 2.5 m, and the flow velocity ranges from 0.6 m/s to 1.2 m/s.

The effective operation of the fishway is one of the important technical means to maintain the longitudinal connectivity of rivers. However, an investigation of existing fishway facilities shows that: it is hard for the traditional fishway to adjust the bottom slope and hydraulic slope of the fishway, resulting that the fishway length is too long and the construction cost is too high, and moreover, the operation of most fishways is not ideal, the fish passage efficiency is not high, and even some fishways have never passed fish at all.

SUMMARY

In order to reduce the requirements of a traditional fishway for the swimming ability and continuous jumping ability of fish, improve the fish passage efficiency of the fishway, protect natural fishery resources and ensure the continuity and diversity of aquatic ecosystem, the present disclosure provides a step-by-step paired and up-down reciprocating combined fishway. The step-by-step paired and up-down reciprocating combined fishway includes several fishway units, a mechanical transmission system, a fish repelling system, a control system, and a recovery cableway.

The fishway units include bottom plates, wing walls, gear belts, sliding slots, sliders, grooves, curved followers, partition plates and roller rows. Each bottom plate is horizontally fixed above a corresponding one of the curved followers, the wing walls are vertically fixed to left and right sides of the bottom plates of the fishway, inner sides of the wing walls are provided with the gear belts, front ends of the wing walls are provided with the sliding slots, and rear ends of the wing walls are provided with the sliders; the wing walls of adjacent fishway units are in an embedment connection and in sliding engagement with each other through the sliding slots and the sliders. The curved followers are fixed on lower surfaces of the bottom plates, and the grooves are transversely formed in bottoms of the curved followers.

The mechanical transmission system includes eccentric wheels, a motor, and a transmission shaft. The eccentric wheels are of a cylindrical structure, are located directly under the curved followers and are in sliding contact with the grooves of the curved followers, and an outer surface of each eccentric wheel is provided with a curved slideway in which several balls are installed, and each eccentric wheel is provided with a shaft hole. And a rotating shaft of the motor is connected to the transmission shaft through a reduction gear set, the transmission shaft penetrates through the shaft holes of all eccentric wheels and is fixedly connected to the shaft holes.

The fish repelling system includes a driving device, a reel, a fish repelling net, a net pocket and a control system. The driving device comprises a driving motor, and a driving shaft and gears connected to the driving motor, and the gears are meshed with the gear belt. An upper end of the fish repelling net is fixed to the reel, and a lower end of the fish repelling net is fixed to the net pocket. The control system is used to control operating states of the motor, the driving device, the reel, a driving wheel, a telescopic rod and a grapple.

The recovery cableway includes a driving wheel, a cable, a cable clamp, a telescopic rod, and a grapple. The driving wheel is a stainless steel cylinder with trenches on its surface, the cable is bound in the trenches of the driving wheel; the cable clamp is secured to the cable; the telescopic rod is able to extend and retract up and down, an upper end of the telescopic rod is connected to the cable clamp, and a lower end of the telescopic rod is connected to the grapple; and the grapple is able to be contracted and expanded freely.

A top part of each curved follower is a plane, and a bottom part of each curved follower is a curved surface, a size of the top part of each curved follower is the same as that of the corresponding bottom plate, and a cross section of each curved follower gradually decreases from top to bottom, an overall shape of each curved follower is an inverted trapezoidal platform with a recessed bottom, and a curvature of the bottom part of each curved follower is the same as that of the corresponding eccentric wheel.

An outer surface of each eccentric wheel is provided with a recessed curved slideway in which several balls are arranged, and the curved slideway is in rolling contact with the grooves transversely formed in the bottom of the corresponding curved follower through the balls.

The eccentric wheels are connected by the transmission shaft penetrating through the shaft holes, and vertical distances from the highest points of adjacent eccentric wheels to the transmission shaft are a far hub radius and a near hub radius of the eccentric wheel, respectively.

The bottom plates of the fishway units decrease gradually in overall height from upstream to downstream, a maximum height difference between the bottom plates of the adjacent fishway units is equal to a difference between the far hub radius and the near hub radius of the eccentric wheels, and a minimum height difference between the bottom plates of the adjacent fishway units is equal to zero.

Both ends of the driving device are provided with the gears which are meshed with the gear belts in motion, and the driving device is controlled by the control system.

The reel is connected to an upper end of the fish repelling net, and the reel is able to retract and release the fish repelling net in time under the drive of the driving device.

Preferably, the partition plates are vertically arranged at front and rear ends of the bottom plates of even-numbered fishway units, and are fixedly connected to the wing walls on the left and right sides thereof; the roller rows are horizontally fixed to inlets and outlets of odd-numbered fishway units, respectively, and bottoms of the roller rows are tangent to the bottom plates, and an outer ring of the roller row is made of wear-resistant rubber.

Preferably, a periphery frame of the net pocket is made of solid stainless steel, and the net pocket is in a shape of a dustpan full of small holes, the net pocket unfolds the fish repelling net by its own gravity, an open end of the net pocket is rectangular in shape, and a bottom of the open end of the net pocket is raised upwards.

Preferably, each sliding slot is in an embedment connection and in sliding engagement with the corresponding slider, wherein said corresponding slider of an upper stage of fishway unit is embedded into said each sliding slot of a lower stage of fishway unit and slides against each other, and each roller of each roller row at adjacent fishway units is tangent to the corresponding partition plate and rolls against each other.

Preferably, the eccentric wheels are arranged at equal distances at the bottom of the fishway unit, to adjust and control the height of the fishway units.

Preferably, when the adjacent fishway units operate to the same height, the gear belts of the adjacent fishway units are just joined together, such that the driving device can pass through the joined gear belt smoothly.

Preferably, a rotating shaft of the motor is connected to the transmission shaft through a reduction gear set.

Preferably, a top part of each curved follower is a plane, and a bottom part of each curved follower is a curved surface, a size of the top part of each curved follower is the same as that of the corresponding bottom plate, and a cross section of each curved follower gradually decreases from top to bottom, an overall shape of each curved follower is an inverted trapezoidal platform with a recessed bottom, and a curvature of the bottom part of each curved follower is the same as that of the corresponding eccentric wheel. A slope of the whole fishway is adjusted by the height of the curved follower.

Preferably, the fish repelling system operates intelligently under the control of the control system. In the same stage fishway unit, the fish repelling net and the net pocket move forwards. When the bottom plates of the adjacent fishway units tend to the same height, the fish repelling net and the net pocket ascend at first and then descend through the rotation of the reel, such that the fish repelling net and the net pocket not only cross the partition plate and the roller row smoothly, but also speed up to repel and assist the migratory fish to swim upstream.

Preferably, according to the present disclosure, multiple fish repelling systems work cooperatively. After each fish repelling system arrives at an exit of the fishway, the fish repelling system arriving at the exit of the fishway is quickly transported to an entrance of the fishway to return to its original position through the recovery cableway, thus ensuring the continuity of fish passage and the continuity of the repelling-assisting process, and effectively improving the fish passage efficiency.

Preferably, during the non-migratory period of fish, the recovery cableway can also be used to quickly transport other items from downstream to upstream.

The technical solutions provided by the present disclosure also include a fish passage method for a step-by-step paired and up-down reciprocating combined fishway, including steps as follows:

Step ①, controlling an operating state of the whole fishway by the control system during a fish migration season, driving the transmission shaft and the eccentric wheels by the motor to rotate, and meanwhile enabling the sliders fixed to both sides of the inlet of the second-stage fishway unit and the sliding slots fixed to both sides of the outlet of the first-stage fishway unit to slide against each other, and enabling the roller row horizontally fixed at the inlet of the second-stage fishway unit and the partition plate vertically fixed on the bottom plate at the outlet of the first-stage fishway unit to roll against each other. A sliding between the slider and the sliding slot and a rolling between the roller row and the partition plate can not only reduce friction, but also prevent water leakage between the two stages of fishway units. When the first-stage fishway unit operates to a highest position, the second-stage fishway unit operates to a lowest position, at the moment, the bottom plates of the two stages of fishway units are flush with each other, and a water flow changes from original free fall to a flat slope open channel water flow, and a flow velocity decreases.

Step ①, controlling the fish repelling system by the control system to start to move upstream along a gear belt during performing step ①, repelling migratory fish in the fishway unit by the fish repelling net and the net pocket to assist the migratory fish to swim upstream, wherein a bottom of the net pocket is proximate to the bottom plate, and the fish repelling net is in a stretching state under the gravity action of the net pocket. When the bottom plate of the first-stage fishway unit is flush with that of the second-stage fishway unit, the gear belt in the first-stage fishway unit is also flush with that of the second-stage fishway unit, and at the moment, the gears at both ends of the driving device in the fish repelling system enter the second-stage fishway unit from the first-stage fishway unit along the gear belts, and meanwhile, the reel starts to rotate clockwise under the control of the control system so as to make the fish repelling net start to contract and move upward, and at the same time the fish repelling net brings the net pocket to move upward, so that the net pocket assists some fish which are unsuccessful to swim upstream to migrate. When the fish repelling net and the net pocket enter the second-stage fishway unit, the reel starts to rotate counterclockwise under the control of the control system, and the fish repelling net and the net pocket descend to a height where the net pocket is proximate to the bottom plate.

Step ③, assisting fish to enter an upper stage of fishway unit in turn by other stages of fishway units according to the processes of step ① and step ② until the fish swims upstream successfully.

Step ④, enabling the fish repelling system to continue to move forwards when the migratory fish enters the last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position. After the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating.

step ⑤, completing all the above steps to finish a fish passage cycle; and with a cooperative work of multiple fish repelling systems, all stages of fishway units assist migratory fish to swim upstream step by step according to the corresponding steps.

According to the corresponding steps, the object of the step-by-step paired and up-down reciprocating combined fish passage of the fishway units can be achieved.

The present disclosure has the beneficial effects as follows.

(1) The elevation of the fishway unit changes with the rotation of the eccentric wheel, which makes a water flow pattern between the adjacent fishway units gradually change from a rapid flow to a slow flow, which is helpful for fish to migrate and swim upstream.

(2) The bottom slope between the adjacent fishway units is greater than that of the traditional fishway, which is helpful to greatly shorten the length of fishway and save the construction cost.

(3) During the rotation of two adjacent eccentric wheels, action forces exerted by the upper two fishways units on the eccentric wheels are opposite in direction, and the action forces can be counteracted each other skillfully, thus reducing the power and energy consumption of the fishway units during operation.

(4) The balls can change sliding friction between the eccentric wheel and the curved follower into rolling friction, which is beneficial to the smooth lifting of the fishway unit.

(5) The sizes and dimensions of the eccentric wheel and the curved follower can be flexibly adjusted according to different topography and geomorphology, and the fishway structure can be flexibly arranged according to topography and geomorphology. By changing the diameter of the eccentric wheel or the height of the curved follower, the elevation difference between the fishway units can be adjusted to adapt to different terrain features.

(6) The fish repelling system can assist migratory fish to migrate well and improve fish passage efficiency.

(7) The sliding between the slider and the sliding slot and the rolling between the roller row and the partition plate not only can reduce friction force between the fishway units, but also can effectively prevent water leakage between two stages of fishways.

(8) The individual fishway units are independent of each other when not in operation, which is convenient for service and maintenance.

(9) According to the present disclosure, multiple fish repelling systems work cooperatively, so as to ensure the continuity of fish passage and the sustainability of the repelling-assisting process, and effectively improve the fish passage efficiency.

(10) The fishway is highly intelligent, and operating states of the motor, the driving device, the reel, the driving wheel, the telescopic rod and the grapple can be controlled by the control system, so as to be suitable for fish with different swinging capacity to swim upstream smoothly.

REFERENCE NUMERALS

1 exit of fishway; 2 fishway unit; 21 bottom plate; 22 wing wall; 23 gear belt; 24 sliding slot; 25 slider; 26 groove; 27 curved follower; 28 partition plate; 29 roller row; 3 entrance of fishway; 4 mechanical transmission system; 5 eccentric wheel; 51 shaft hole; 52 ball; 53 curved slideway; 6 motor;

61 transmission shaft; 7 fish repelling system; 71 driving device; 72 reel; 73 fish repelling net; 74 net pocket; 75 control system; 8 recovery cableway; 81 driving wheel; 82 cable; 83 cable clamp; 84 telescopic rod; 85 grapple.

DETAILED DESCRIPTION OF THE EMBODIMENTS

Figure 1:
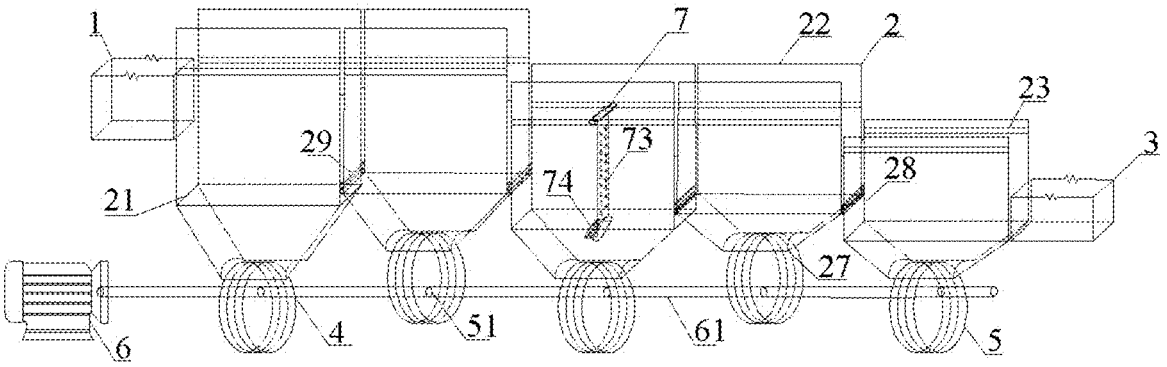
FIG. 1 is a schematic diagram of an overall structure of a step-by-step paired and up-down reciprocating combined fishway in accordance with the present disclosure.
Figure 2:
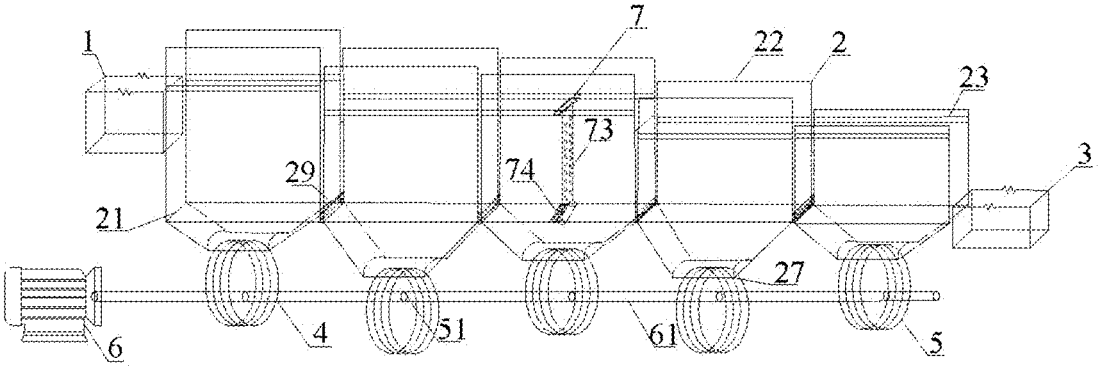
FIG. 2 is a schematic structural diagram of fishway units in FIG. 1 with a half cycle of the whole reciprocating motion completed.
Figure 3:
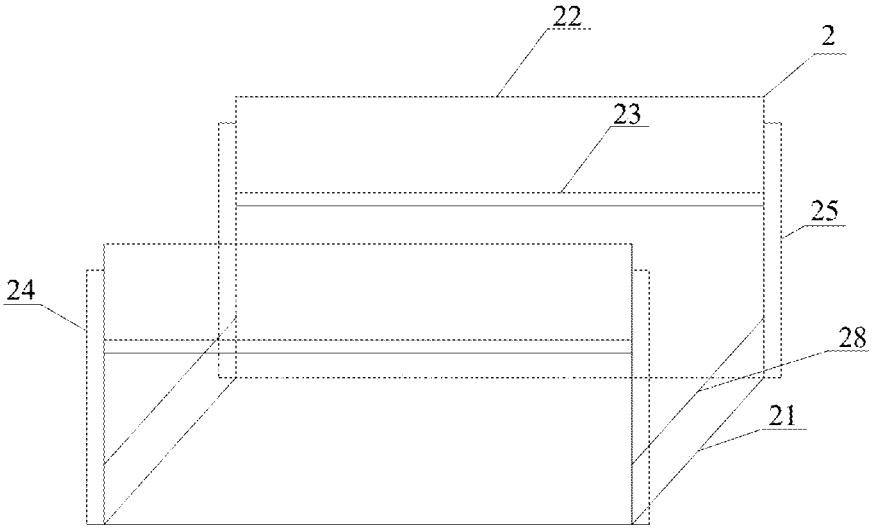
FIG. 3 is a schematic structural diagram of a fishway unit in FIG. 1.
Figure 4:
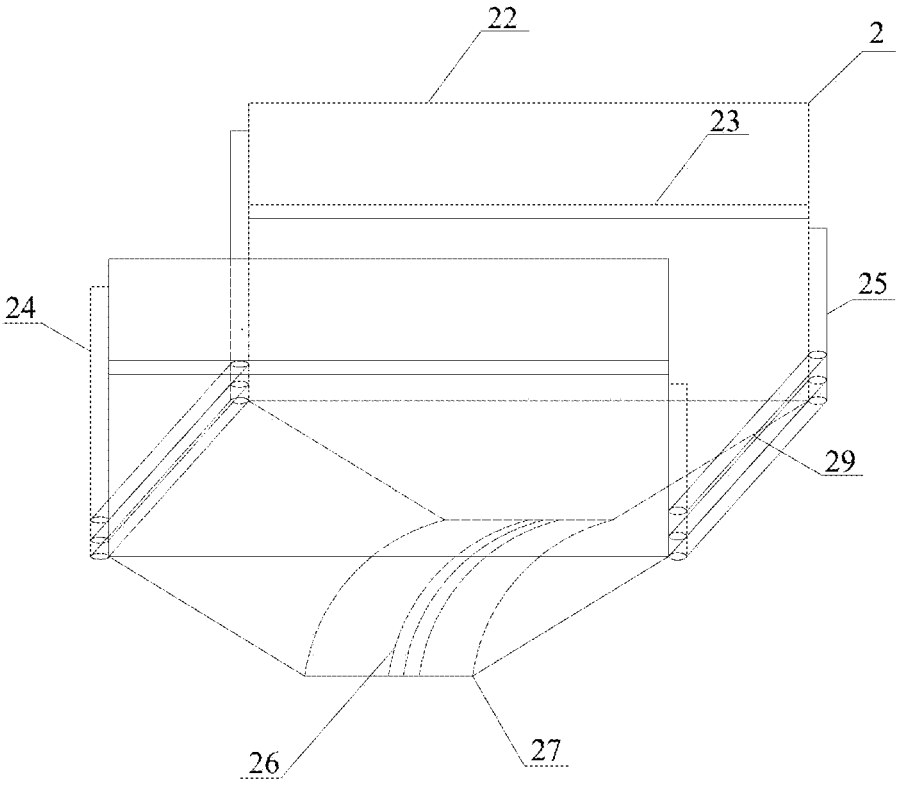
FIG. 4 is a schematic structural diagram of a roller row, a fishway unit and a curved follower at a lower part of the fishway unit in FIG. 1.
Figure 5:
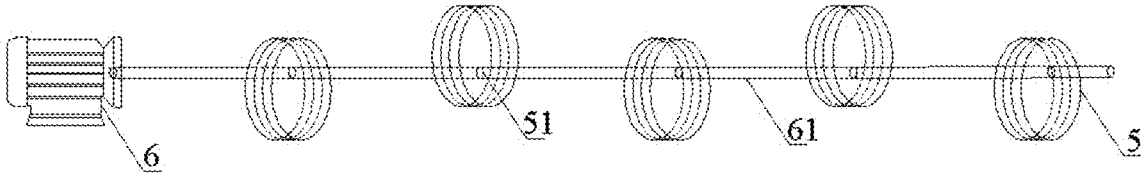
FIG. 5 is a schematic structural diagram of a mechanical transmission system in accordance with the present disclosure.
Figure 6:
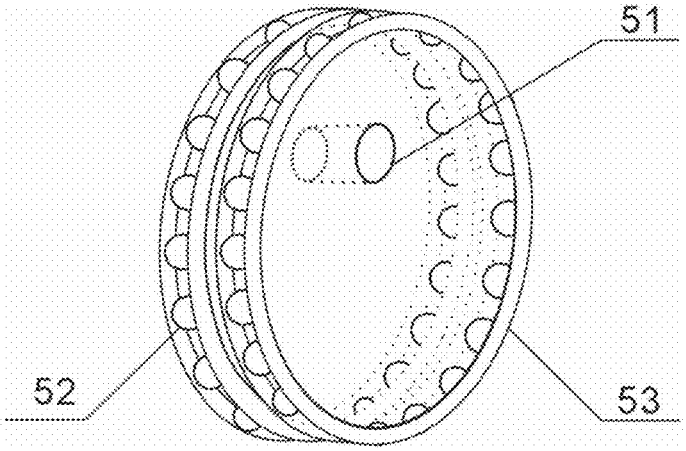
FIG. 6 is a schematic structural diagram of an eccentric wheel in accordance with the present disclosure.
Figure 7:
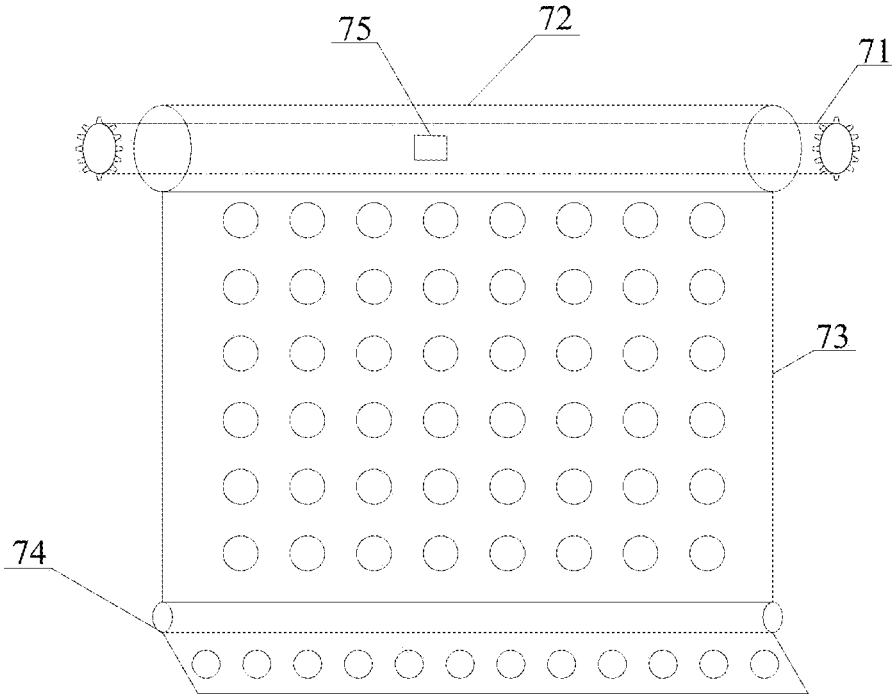
FIG. 7 is a schematic structural diagram of a fish repelling system in accordance with the present disclosure.
Figure 8:
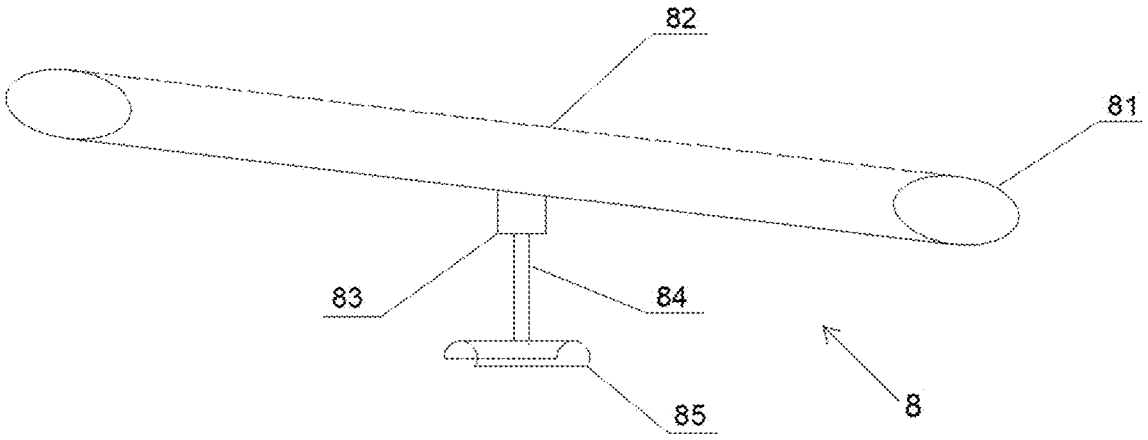
FIG. 8 is a schematic structural diagram of a recovery cableway in accordance with the present disclosure.

The present disclosure is further described below with reference to FIGS. 1~8.

Embodiment

A step-by-step paired and up-down reciprocating combined fishway includes five fishway units 2, a mechanical transmission system 4, two fish repelling systems 7, a control system 75 and a recovery cableway 8. The fishway units 2 include bottom plates 21, wing walls 22, gear belts 23, sliding slots 24, sliders 25, grooves 26, curved followers 27, partition plates 28 and roller rows 29. The bottom plate 21 is rectangular and is horizontally fixed to a bottom of the fishway unit 2. Two wing walls 22 of the fishway are perpendicularly fixed to left and right sides of the bottom plate 21 of the fishway, an inner side of each wing wall 22 is provided with the gear belt 23, and the length of the gear belt 23 is the same as that of the wing wall 22. Front ends of the wing walls 22 are provided with the sliding slots 24, and rear ends of the wing walls 22 are provided with the sliders 25. Each sliding slot 24 is shaped like a channel steel, is sealed at the bottom, and has an outward opening, the height of the sliding slot 24 is lower than that of the gear belt 23, and the sliding slot is vertically fixed on each of both sides of an outlet of the fishway unit 2. There is no sliding slot at the outlet of the last upstream fishway unit 2. The slider 25 is a solid cuboid block and is used in combination with the sliding slot 24. The slider 25 can be inserted into the sliding slot 24 and slide up and down. The slider 25 is perpendicularly fixed to each of both sides of an inlet of the fishway unit 2, and a bottom of the slider 25 is fixed to an upper surface of the bottom plate 21 of the fishway unit 2. The curved follower 27 is fixed on a lower surface of the bottom plate 21, and the grooves 26 are transversely formed in a bottom of the curved follower 27. The partition plates 28 are perpendicularly arranged at front and rear ends of the bottom plates 21 of a second fish unit 2 and a fourth fishway unit 2, and are fixedly connected to the wing walls 22 on the left and right sides of the fishway units. The roller rows 29 are horizontally fixed at both inlet and outlet of a third fishway unit 2, and an outlet of a first fishway unit 2 and an inlet of a fifth fishway unit 2, respectively. A bottom of the roller row 29 is tangent to the bottom plate 21, and an outer ring of the roller row 29 is made of wear-resistant rubber. The mechanical transmission system 4 is composed of five eccentric wheels 5, a motor 6, and a transmission shaft 61. The eccentric wheels 5 are of a cylindrical structure. The eccentric wheel 5 is located directly under the curved follower 27 and is in sliding contact with the grooves 26 of the curved follower 27. An outer surface of each eccentric wheel 5 is provided with a curved slideway 53 in which several balls 52 are installed. And the eccentric wheel 5 is provided with a shaft hole 51. The ball 52 is made of a stainless steel solid ball. A rotating shaft of the motor 6 is connected to the transmission shaft 61 through a reduction gear set, and the transmission shaft 61 is penetrated through the shaft holes 51 of all eccentric wheels 5 and is fixedly connected to the shaft holes 51.

The fish repelling system 7 is composed of a driving device 71, a reel 72, a fish repelling net 73, a net pocket 74 and a control system 75. The driving device 71 is controlled by the control system 75. The driving device 71 includes a driving motor, and a driving shaft and a gear which are connected to the driving motor, and the gear is meshed with the gear belt 23 in motion. When the adjacent fishway units operate to the same height, the gear belts 23 of the adjacent fishway units 2 are joined together, such that the driving device 71 passes through the joined gear belts 23 smoothly. The reel 72 is connected to an upper end of the fish repelling net 73, and is driven by the driving device 71 to retract and release the fish repelling net 73 in time. The fish repelling net 73 is made of a high-strength carbon fiber flexible material, the upper end of the fish repelling net 73 is fixed to the reel 72, and a lower end of the fish repelling net 73 is fixed to the net pocket 74. A periphery frame of the net pocket 74 is made of solid stainless steel, and the net pocket 74 is in a shape of a dustpan full with small holes. The net pocket 74 unfolds the fish repelling net 73 by its own gravity, an open end of the net pocket 74 is rectangular in shape, and a bottom of the open end of the net pocket 74 is raised upward. The control system 75 is used to control operating states of the motor 6, the driving device 71, the reel 72, a driving wheel 81, a telescopic rod 84, and a grapple 85. The recovery cableway 8 is composed of the driving wheel 81, a cable 82, a cable clamp 83, the telescopic rod 84, and the grapple 85. The driving wheel 81 is a stainless steel cylinder with trenches on its surface, and the cable 82 is bound in the trenches of the driving wheel 81. The cable clamp 83 is secured to the cable 82, the telescopic rod 84 can extend and retract up and down, an upper end of the telescopic rod 84 is connected to the cable clamp 83, and a lower end thereof is connected to the grapple 85. The grapple 85 can be contracted and expanded freely.

In this embodiment, a top part of the curved follower 27 is a plane, and a bottom part of the curved follower 27 is a curved surface. A size of the top part of the curved follower 27 is the same as that of the bottom plate 21, and a cross section of the curved follower 27 gradually decreases from top to bottom, and an overall shape of the curved follower 27 is an inverted trapezoidal platform with a recessed bottom, and a curvature of the bottom part of the curved follower 27 is the same as that of the eccentric wheel 5.

In this embodiment, an outer surface of the eccentric wheel 5 is provided with a recessed curved slideway 53 in which several balls 52 are arranged, and the curved slideway 53 is in rolling contact with the grooves 26 transversely formed in the bottom of the curved follower 27 through the balls 52.

In this embodiment, the bottom plates 21 of the fishway units 2 decrease gradually in overall height from upstream to downstream, the maximum height difference between the bottom plates 21 of the adjacent fishway units 2 is equal to a difference between a far hub radius and a near hub radius of the eccentric wheel 5, and the minimum height difference between the bottom plates 21 of the adjacent fishway units 2 is equal to zero. The eccentric wheels 5 are connected by the transmission shaft 61 penetrating through the shaft holes 51, and vertical distances from the highest points of adjacent eccentric wheels 5 to the transmission shaft 61 are the far hub radius and the near hub radius of the eccentric wheel 5, respectively.

In this embodiment, the sliding slot 24 is in an embedment connection and in sliding engagement with the slider 25, wherein the slider 25 of an upper stage of fishway unit 2 is embedded into the sliding slot 24 of the lower stage of fishway unit 2 and slides with each other; and each roller of the roller row 29 at adjacent fishway units 2 is tangent to the respective partition plate 28 and rolls against each other.

In a step-by-step paired and up-down reciprocating combined fishway based on the above description, a fishway operation process is intelligently executed by the control system 75 to transport fish schools to the upstream step by step. A fish passage method in this embodiment includes the following steps.

①During the fish migration season, an operating state of the whole fishway is controlled by a control system 75. A transmission shaft 61 and eccentric wheels 5 are driven by a motor 6 to rotate, and meanwhile, sliders 25 fixed to both sides of an inlet of a second-stage fishway unit and sliding slots 24 fixed to both sides of an outlet of a first-stage fishway unit slide against each other, and a roller row 29 horizontally fixed at the inlet of the second-stage fishway unit and a partition plate 28 vertically fixed on a bottom plate 21 at the outlet of the first-stage fishway unit roll against each other. When the first-stage fishway unit operates to the highest position, the second-stage fishway unit operates to the lowest position, at the moment, bottom plates 21 of the two stages of fishway units are flush with each other, and a water flow changes from original free fall to a flat slope open channel water flow, and the flow velocity decreases.

②During performing step ①, a fish repelling system 7 starts to move upstream along a gear belt 23 under the control of the control system 75, a fish repelling net 73 and a net pocket 74 are used to repel migratory fish in the fishway unit, thus assisting the migratory fish to swim upstream. The bottom of the net pocket 74 is proximate to the bottom plate 21, and the fish repelling net 73 is in a stretching state under the gravity action of the net pocket 74. When the bottom plate 21 of the first-stage fishway unit is flush with that of the second-stage fishway unit, a gear belt 23 in the first-stage fishway unit is also flush with that in the second-stage fishway unit, and at the moment, gears at both ends of a driving device 71 in the fish repelling system 7 enter the second-stage fishway unit from the first-stage fishway unit along the gear belts 23. Meanwhile, a reel 72 starts to rotate clockwise under the control of the control system 75 so as to make the fish repelling net 73 begin to contract and move upward, and at the same time, the fish repelling net 73 drives the net pocket 74 to move upward, and the net pocket 74 can assist some fish which are unsuccessful to swim upstream to migrate. When the fish repelling net 73 and the net pocket 74 enter the second-stage fishway unit, the reel 72 starts to rotate counterclockwise under the control of the control system 75, and the fish repelling net 73 and the net pocket 74 descend to a height where the net pocket 74 is proximate to the bottom plate 21.

③Other stages of fishway units continue to assist fish to enter an upper stage of fishway unit in turn according to the processes of step ① and step ② until the fish swims upstream successfully.

④ When the migratory fish enters the last stage of fishway unit, the fish repelling system 7 continues to move forwards, when the fish repelling system 7 arrives at an exit of the fishway, the fish repelling system 7 stops operating, and meanwhile the reel 72 starts to rotate clockwise until the fish repelling net 73 is completely retracted. After the fish repelling net 73 is completely retracted, the control system 75 controls a telescopic rod 84 to extend downwards, and controls the telescopic rod 84 to start to retract and move upward after a grapple 85 grasps the fish repelling system 7. The control system 75 controls a driving wheel 81 to start to rotate. The driving wheel 81 drives a cable 82 to move downwards, the cable 82 brings a cable clamp 83 to move downstream until the fish repelling system 7 is conveyed to an entrance of the fishway, the driving wheel 81 stops rotating, the telescopic rod 84 starts to move downwards to an appropriate height, the grapple 85 is opened to place the fish repelling system 7 in an initial position. After the fish repelling system 7 is placed in the initial position, the reel 72 starts to rotate counterclockwise to lower the fish repelling net 73 and the net pocket 74 until reaching an initial state. Meanwhile, the driving wheel 81 starts to rotate under the control of the control system 75, so as to drive the cable 82 and the cable clamp 83 to move until the cable clamp 83 arrives at an upstream exit of the fishway, and the driving wheel 81 stops rotating.

⑤ The completion of all the above steps is a fish passage cycle. With the cooperative work of multiple fish repelling systems 7, the fishway units at all levels assist migratory fish to trace back step by step according to the corresponding steps mentioned above.

What is claimed is:

1. A step-by-step paired and up-down reciprocating combined fishway, comprising several fishway units, a mechanical transmission system, a fish repelling system, a control system, and a recovery cableway, wherein the fishway units comprise bottom plates, wing walls, gear belts, sliding slots, sliders, grooves, curved followers, partition plates, and roller rows; each bottom plate is horizontally fixed above a corresponding one of the curved followers, the wing walls are vertically fixed to left and right sides of the bottom plates of the fishway, inner sides of the wing walls are provided with the gear belts, front ends of the wing walls are provided with the sliding slots, and rear ends of the wing walls are provided with the sliders; the wing walls of adjacent fishway units are in an embedment connection and in sliding engagement with each other through the sliding slots and the sliders; the curved followers are fixed on lower surfaces of the bottom plates, and the grooves are transversely formed in bottoms of the curved followers; the partition plates are vertically arranged at front and rear ends of the bottom plates of even-numbered fishway units, and are fixedly connected to the wing walls on the left and right sides thereof; the roller rows are horizontally fixed to inlets and outlets of odd-numbered fishway units, respectively, and bottoms of the roller rows are tangent to the bottom plates;

the mechanical transmission system comprises eccentric wheels, a motor, and a transmission shaft; the eccentric wheels are of a cylindrical structure, are located directly under the curved followers and are in sliding contact with the grooves of the curved followers, and an outer surface of each eccentric wheel is provided with a curved slideway in which several balls are installed, and each eccentric wheel is provided with a shaft hole; and a rotating shaft of the motor is connected to the transmission shaft through a reduction gear set, the transmission shaft penetrates through the shaft holes of all eccentric wheels and is fixedly connected to the shaft holes;

the fish repelling system comprises a driving device, a reel, a fish repelling net, a net pocket and a control system; the driving device comprises a driving motor, and a driving shaft and gears connected to the driving motor, and the gears are meshed with the gear belts; an upper end of the fish repelling net is fixed to the reel, and a lower end of the fish repelling net is fixed to the net pocket; a periphery frame of the net pocket is made of solid stainless steel, and the net pocket is in a shape of a dustpan full of small holes, the net pocket unfolds the fish repelling net by gravity of the net pocket, an open end of the net pocket is rectangular in shape, and a bottom of the open end of the net pocket is raised upwards;

the control system is used to control operating states of the motor, the driving device, the reel, a driving wheel, a telescopic rod and a grapple;

the recovery cableway comprises the driving wheel, a cable, a cable clamp, the telescopic rod, and the grapple; the driving wheel is a stainless steel cylinder with trenches on a surface of the cylinder, the cable is bound in the trenches of the driving wheel; the cable clamp is secured to the cable; the telescopic rod is able to extend and retract up and down, an upper end of the telescopic rod is connected to the cable clamp, and a lower end of the telescopic rod is connected to the grapple; and the grapple is able to be contracted and expanded freely.

2. The step-by-step paired and up-down reciprocating combined fishway according to claim 1, wherein a top part of each curved follower is a plane, and a bottom part of each curved follower is a curved surface, a size of the top part of each curved follower is the same as a size of a corresponding one of the bottom plates, and a cross section of each curved follower gradually decreases from top to bottom, an overall shape of each curved follower is an inverted trapezoidal platform with a recessed bottom, and a curvature of the bottom part of each curved follower is the same as a curvature of a corresponding one of the eccentric wheels.

3. The step-by-step paired and up-down reciprocating combined fishway according to claim 1, wherein an outer surface of each eccentric wheel is provided with a recessed curved slideway in which several balls are arranged, and the curved slideway is in rolling contact with the grooves transversely formed in the bottom of the corresponding curved follower through the balls.

4. The step-by-step paired and up-down reciprocating combined fishway according to claim 1, wherein the bottom plates of the fishway units decrease gradually in overall height from upstream to downstream, a maximum height difference between the bottom plates of the fishway units which are adjacent to each other is equal to a difference between a far hub radius and a near hub radius of the eccentric wheels, and a minimum height difference between the bottom plates of the adjacent fishway units is equal to zero.

5. The step-by-step paired and up-down reciprocating combined fishway according to claim 1, wherein the eccentric wheels are connected by the transmission shaft penetrating through the shaft holes, and vertical distances from the highest points of adjacent eccentric wheels to the transmission shaft are the far hub radius and the near hub radius of the eccentric wheel, respectively.

6. The step-by-step paired and up-down reciprocating combined fishway according to claim 1, wherein both ends of the driving device are provided with the gears which are meshed with the gear belts in motion; and when the fishway units which are adjacent to each other operate to a same height, the gear belts of the adjacent fishway units are just joined together, and the driving device passes through the joined gear belts smoothly.

7. The step-by-step paired and up-down reciprocating combined fishway according to claim 1, wherein each sliding slot is in an embedment connection and in sliding engagement with a corresponding one of the sliders, wherein said slider of an upper stage of fishway unit is embedded into said each sliding slot of a lower stage of fishway unit and slides against each other, and each roller of each roller row at adjacent fishway units is tangent to a corresponding one of the partition plates and rolls against each other.

8. The step-by-step paired and up-down reciprocating combined fishway according to claim 1, wherein both ends of the driving device are provided with the gears which are meshed with the gear belts in motion, and the driving device is controlled by the control system; the reel is connected to an upper end of the fish repelling net, and the reel is able to retract and release the fish repelling net in time under the drive of the driving device.

9. A fish passage method of the step-by-step paired and up-down reciprocating combined fishway according to claim 1, comprising steps as follows:

step ①, controlling an operating state of the whole fishway by a control system during a fish migration season, driving a transmission shaft and eccentric wheels by a motor to rotate, and meanwhile enabling sliders fixed to both sides of an inlet of a second-stage fishway unit and sliding slots fixed to both sides of an outlet of a first-stage fishway unit to slide against each other, and enabling roller rows horizontally fixed at the inlet of the second-stage fishway unit and partition plates vertically fixed on bottom plates at the outlet of the first-stage fishway unit to roll against each other, wherein a sliding between the sliders and the sliding slots and a rolling between the roller rows and the partition plates can not only reduce friction, but also prevent water leakage between the two stages of fishway units; the first-stage fishway unit operates to a highest position, the second-stage fishway unit operates to a lowest position, the bottom plates of the two stages of fishway units are flush with each other, and a water flow changes from original free fall to a flat slope open channel water flow, and a flow velocity decreases;

step ②, controlling a fish repelling system by the control system to start to move upstream along the gear belts during performing step ①, repelling migratory fish in the fishway units by a fish repelling net and a net pocket to assist the migratory fish to swim upstream, wherein a bottom of the net pocket is proximate to the bottom plates, and the fish repelling net is in a stretching state under gravity action of the net pocket; the bottom plates of the first-stage fishway unit is flush with the bottom plates of the second-stage fishway unit, the gear belts in the first-stage fishway unit is also flush with the gear belts of the second-stage fishway unit, gears at both ends of the driving device in the fish repelling system enter the second-stage fishway unit from the first-stage fishway unit along the gear belts, and meanwhile, the reel starts to rotate clockwise under the control of the control system so as to make the fish repelling net start to contract and move upward, and at the same time the fish repelling net brings the net pocket to move upward, so that the net pocket assists some fish which are unsuccessful to swim upstream to migrate; and the fish repelling net and the net pocket enter the second-stage fishway unit, the reel starts to rotate counterclockwise under the control of the control system, and the fish repelling net and the net pocket descend to a height where the net pocket is proximate to the bottom plates;

step ③, assisting fish to enter an upper stage of fishway unit in turn by other stages of fishway units according to the processes of step ① and step ② until the fish swims upstream successfully;

step ④, enabling the fish repelling system to continue to move forwards and the migratory fish enters a last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position; after the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating; and step ⑤, completing all the above steps to finish a fish passage cycle; and with a cooperative work of a plurality of fish repelling systems, all stages of fishway units assist migratory fish to swim upstream step by step according to the corresponding steps.

10. A fish passage method of the step-by-step paired and up-down reciprocating combined fishway according to claim 2, comprising steps as follows:

step ①, controlling an operating state of the whole fishway by a control system during a fish migration season, driving a transmission shaft and eccentric wheels by a motor to rotate, and meanwhile enabling sliders fixed to both sides of an inlet of a second-stage fishway unit and sliding slots fixed to both sides of an outlet of a first-stage fishway unit to slide against each other, and enabling roller rows horizontally fixed at the inlet of the second-stage fishway unit and partition plates vertically fixed on bottom plates at the outlet of the first-stage fishway unit to roll against each other, wherein a sliding between the sliders and the sliding slots and a rolling between the roller rows and the partition plates can not only reduce friction, but also prevent water leakage between the two stages of fishway units; the first-stage fishway unit operates to a highest position, the second-stage fishway unit operates to a lowest position, the bottom plates of the two stages of fishway units are flush with each other, and a water flow changes from original free fall to a flat slope open channel water flow, and a flow velocity decreases;

step ②, controlling a fish repelling system by the control system to start to move upstream along the gear belts during performing step ①, repelling migratory fish in the fishway units by a fish repelling net and a net pocket to assist the migratory fish to swim upstream, wherein a bottom of the net pocket is proximate to the bottom plates, and the fish repelling net is in a stretching state under gravity action of the net pocket; the bottom plates of the first-stage fishway unit is flush with the bottom plates of the second-stage fishway unit, the gear belts in the first-stage fishway unit is also flush with the gear belts of the second-stage fishway unit, gears at both ends of the driving device in the fish repelling system enter the second-stage fishway unit from the first-stage fishway unit along the gear belts, and meanwhile, the reel starts to rotate clockwise under control of the control system so as to make the fish repelling net start to contract and move upward, and at the same time the fish repelling net brings the net pocket to move upward, so that the net pocket assists some fish which are unsuccessful to swim upstream to migrate; and when the fish repelling net and the net pocket enter the second-stage fishway unit, the reel starts to rotate counterclockwise under the control of the control system, and the fish repelling net and the net pocket descend to a height where the net pocket is proximate to the bottom plates;

step ③, assisting fish to enter an upper stage of fishway unit in turn by other stages of fishway units according to the processes of step ① and step ② until the fish swims upstream successfully;

step ④, enabling the fish repelling system to continue to move forwards and the migratory fish enters a last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position; after the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating; and step ⑤, completing all the above steps to finish a fish passage cycle; and with a cooperative work of a plurality of fish repelling systems, all stages of fishway units assist migratory fish to swim upstream step by step according to the corresponding steps.

11. A fish passage method of the step-by-step paired and up-down reciprocating combined fishway according to claim 3, comprising steps as follows:

step ①, controlling an operating state of the whole fishway by a control system during a fish migration season, driving a transmission shaft and eccentric wheels by a motor to rotate, and meanwhile enabling sliders fixed to both sides of an inlet of a second-stage fishway unit and sliding slots fixed to both sides of an outlet of a first-stage fishway unit to slide against each other, and enabling roller rows horizontally fixed at the inlet of the second-stage fishway unit and partition plates vertically fixed on bottom plates at the outlet of the first-stage fishway unit to roll against each other, wherein a sliding between the sliders and the sliding slots and a rolling between the roller rows and the partition plates can not only reduce friction, but also prevent water leakage between the two stages of fishway units; the first-stage fishway unit operates to a highest position, the second-stage fishway unit operates to a lowest position, the bottom plates of the two stages of fishway units are flush with each other, and a water flow changes from original free fall to a flat slope open channel water flow, and a flow velocity decreases;

step ②, controlling a fish repelling system by the control system to start to move upstream along the gear belts during performing step ①, repelling migratory fish in the fishway units by a fish repelling net and a net pocket to assist the migratory fish to swim upstream, wherein a bottom of the net pocket is proximate to the bottom plates, and the fish repelling net is in a stretching state under gravity action of the net pocket; the bottom plates of the first-stage fishway unit is flush with the bottom plates of the second-stage fishway unit, the gear belts in the first-stage fishway unit is also flush with the gear belts of the second-stage fishway unit, gears at both ends of the driving device in the fish repelling system enter the second-stage fishway unit from the first-stage fishway unit along the gear belts, and meanwhile, the reel starts to rotate clockwise under control of the control system so as to make the fish repelling net start to contract and move upward, and at the same time the fish repelling net brings the net pocket to move upward, so that the net pocket assists some fish which are unsuccessful to swim upstream to migrate; and when the fish repelling net and the net pocket enter the second-stage fishway unit, the reel starts to rotate counterclockwise under the control of the control system, and the fish repelling net and the net pocket descend to a height where the net pocket is proximate to the bottom plates;

step ③, assisting fish to enter an upper stage of fishway unit in turn by other stages of fishway units according to the processes of step ① and step ② until the fish swims upstream successfully;

step ④, enabling the fish repelling system to continue to move forwards and the migratory fish enters a last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position; after the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating; and step ⑤, completing all the above steps to finish a fish passage cycle; and with a cooperative work of a plurality of fish repelling systems, all stages of fishway units assist migratory fish to swim upstream step by step according to the corresponding steps.

12. A fish passage method of the step-by-step paired and up-down reciprocating combined fishway according to claim 4, comprising steps as follows:

step ①, controlling an operating state of the whole fishway by a control system during a fish migration season, driving a transmission shaft and eccentric wheels by a motor to rotate, and meanwhile enabling sliders fixed to both sides of an inlet of a second-stage fishway unit and sliding slots fixed to both sides of an outlet of a first-stage fishway unit to slide against each other, and enabling roller rows horizontally fixed at the inlet of the second-stage fishway unit and partition plates vertically fixed on bottom plates at the outlet of the first-stage fishway unit to roll against each other, wherein a sliding between the sliders and the sliding slots and a rolling between the roller rows and the partition plates can not only reduce friction, but also prevent water leakage between the two stages of fishway units; the first-stage fishway unit operates to a highest position, the second-stage fishway unit operates to a lowest position, the bottom plates of the two stages of fishway units are flush with each other, and a water flow changes from original free fall to a flat slope open channel water flow, and a flow velocity decreases;

step ②, controlling a fish repelling system by the control system to start to move upstream along the gear belts during performing step ①, repelling migratory fish in the fishway units by a fish repelling net and a net pocket to assist the migratory fish to swim upstream, wherein a bottom of the net pocket is proximate to the bottom plates, and the fish repelling net is in a stretching state under gravity action of the net pocket; the bottom plates of the first-stage fishway unit is flush with the bottom plates of the second-stage fishway unit, the gear belts in the first-stage fishway unit is also flush with the gear belts of the second-stage fishway unit, gears at both ends of the driving device in the fish repelling system enter the second-stage fishway unit from the first-stage fishway unit along the gear belts, and meanwhile, the reel starts to rotate clockwise under control of the control system so as to make the fish repelling net start to contract and move upward, and at the same time the fish repelling net brings the net pocket to move upward, so that the net pocket assists some fish which are unsuccessful to swim upstream to migrate; and when the fish repelling net and the net pocket enter the second-stage fishway unit, the reel starts to rotate counterclockwise under the control of the control system, and the fish repelling net and the net pocket descend to a height where the net pocket is proximate to the bottom plates;

step ③, assisting fish to enter an upper stage of fishway unit in turn by other stages of fishway units according to the processes of step ① and step ② until the fish swims upstream successfully;

step ④, enabling the fish repelling system to continue to move forwards and the migratory fish enters the last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position; after the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating; and step ⑤, completing all the above steps to finish a fish passage cycle; and with a cooperative work of a plurality of fish repelling systems, all stages of fishway units assist migratory fish to swim upstream step by step according to the corresponding steps.

13. A fish passage method of the step-by-step paired and up-down reciprocating combined fishway according to claim 5, comprising steps as follows:

step ①, controlling an operating state of the whole fishway by a control system during a fish migration season, driving a transmission shaft and eccentric wheels by a motor to rotate, and meanwhile enabling sliders fixed to both sides of an inlet of a second-stage fishway unit and sliding slots fixed to both sides of an outlet of a first-stage fishway unit to slide against each other, and enabling roller rows horizontally fixed at the inlet of the second-stage fishway unit and partition plates vertically fixed on bottom plates at the outlet of the first-stage fishway unit to roll against each other, wherein a sliding between the sliders and the sliding slots and a rolling between the roller rows and the partition plates can not only reduce friction, but also prevent water leakage between the two stages of fishway units; the first-stage fishway unit operates to a highest position, the second-stage fishway unit operates to a lowest position, the bottom plates of the two stages of fishway units are flush with each other, and a water flow changes from original free fall to a flat slope open channel water flow, and a flow velocity decreases;

step ②, controlling a fish repelling system by the control system to start to move upstream along the gear belts during performing step ①, repelling migratory fish in the fishway units by a fish repelling net and a net pocket to assist the migratory fish to swim upstream, wherein a bottom of the net pocket is proximate to the bottom plates, and the fish repelling net is in a stretching state under gravity action of the net pocket; the bottom plates of the first-stage fishway unit is flush with the bottom plates of the second-stage fishway unit, the gear belts in the first-stage fishway unit is also flush with the gear belts of the second-stage fishway unit, gears at both ends of the driving device in the fish repelling system enter the second-stage fishway unit from the first-stage fishway units along the gear belts, and meanwhile, the reel starts to rotate clockwise under control of the control system so as to make the fish repelling net start to contract and move upward, and at the same time the fish repelling net brings the net pocket to move upward, so that the net pocket assists some fish which are unsuccessful to swim upstream to migrate; and the fish repelling net and the net pocket enter the second-stage fishway unit, the reel starts to rotate counterclockwise under the control of the control system, and the fish repelling net and the net pocket descend to a height where the net pocket is proximate to the bottom plates step ③, assisting fish to enter an upper stage of fishway unit in turn by other stages of fishway units according to the processes of step ① and step ② until the fish swims upstream successfully;

step ④, enabling the fish repelling system to continue to move forwards and the migratory fish enters a last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position; after the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating; and step ⑤, completing all the above steps to finish a fish passage cycle; and with a cooperative work of a plurality of fish repelling systems, all stages of fishway units assist migratory fish to swim upstream step by step according to the corresponding steps.

14. A fish passage method of the step-by-step paired and up-down reciprocating combined fishway according to claim 6, comprising steps as follows:

step ①, controlling an operating state of the whole fishway by a control system during a fish migration season, driving a transmission shaft and eccentric wheels by a motor to rotate, and meanwhile enabling sliders fixed to both sides of an inlet of a second-stage fishway unit and sliding slots fixed to both sides of an outlet of a first-stage fishway unit to slide against each other, and enabling roller rows horizontally fixed at the inlet of the second-stage fishway unit and partition plates vertically fixed on bottom plates at the outlet of the first-stage fishway unit to roll against each other, wherein a sliding between the sliders and the sliding slots and a rolling between the roller rows and the partition plates can not only reduce friction, but also prevent water leakage between the two stages of fishway units; the first-stage fishway unit operates to a highest position, the second-stage fishway unit operates to a lowest position, the bottom plates of the two stages of fishway units are flush with each other, and a water flow changes from original free fall to a flat slope open channel water flow, and a flow velocity decreases;

step ②, controlling a fish repelling system by the control system to start to move upstream along the gear belts during performing step ①, repelling migratory fish in the fishway units by a fish repelling net and a net pocket to assist the migratory fish to swim upstream, wherein a bottom of the net pocket is proximate to the bottom plates, and the fish repelling net is in a stretching state under gravity action of the net pocket; the bottom plates of the first-stage fishway unit is flush with the bottom plates of the second-stage fishway unit, the gear belts in the first-stage fishway unit is also flush with the gear belts of the second-stage fishway unit, gears at both ends of the driving device in the fish repelling system enter the second-stage fishway unit from the first-stage fishway unit along the gear belts, and meanwhile, the reel starts to rotate clockwise under control of the control system so as to make the fish repelling net start to contract and move upward, and at the same time the fish repelling net brings the net pocket to move upward, so that the net pocket assists some fish which are unsuccessful to swim upstream to migrate; and when the fish repelling net and the net pocket enter the second-stage fishway unit, the reel starts to rotate counterclockwise under the control of the control system, and the fish repelling net and the net pocket descend to a height where the net pocket is proximate to the bottom plates;

step ③, assisting fish to enter an upper stage of fishway unit in turn by other stages of fishway units according to the processes of step ① and step ② until the fish swims upstream successfully;

step ④, enabling the fish repelling system to continue to move forwards and the migratory fish enters a last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position; after the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating; and step ⑤, completing all the above steps to finish a fish passage cycle; and with a cooperative work of a plurality of fish repelling systems, all stages of fishway units assist migratory fish to swim upstream step by step according to the corresponding steps.

15. A fish passage method of the step-by-step paired and up-down reciprocating combined fishway according to claim 7, comprising steps as follows:

step ①, controlling an operating state of the whole fishway by a control system during a fish migration season, driving a transmission shaft and eccentric wheels by a motor to rotate, and meanwhile enabling sliders fixed to both sides of an inlet of a second-stage fishway unit and sliding slots fixed to both sides of an outlet of a first-stage fishway unit to slide against each other, and enabling roller rows horizontally fixed at the inlet of the second-stage fishway unit and partition plates vertically fixed on bottom plates at the outlet of the first-stage fishway unit to roll against each other, wherein a sliding between the sliders and the sliding slots and a rolling between the roller rows and the partition plates can not only reduce friction, but also prevent water leakage between the two stages of fishway units; the first-stage fishway unit operates to a highest position, the second-stage fishway unit operates to a lowest position, the bottom plates of the two stages of fishway units are flush with each other, and a water flow changes from original free fall to a flat slope open channel water flow, and a flow velocity decreases;

step ②, controlling a fish repelling system by the control system to start to move upstream along the gear belts during performing step ①, repelling migratory fish in the fishway units by a fish repelling net and a net pocket to assist the migratory fish to swim upstream, wherein a bottom of the net pocket is proximate to the bottom plates, and the fish repelling net is in a stretching state under gravity action of the net pocket; the bottom plates of the first-stage fishway unit is flush with the bottom plates of the second-stage fishway unit, the gear belts in the first-stage fishway unit is also flush with the gear belts of the second-stage fishway unit, gears at both ends of the driving device in the fish repelling system enter the second-stage fishway unit from the first-stage fishway unit along the gear belts, and meanwhile, the reel starts to rotate clockwise under control of the control system so as to make the fish repelling net start to contract and move upward, and at the same time the fish repelling net brings the net pocket to move upward, so that the net pocket assists some fish which are unsuccessful to swim upstream to migrate; and the fish repelling net and the net pocket enter the second-stage fishway unit, the reel starts to rotate counterclockwise under the control of the control system, and the fish repelling net and the net pocket descend to a height where the net pocket is proximate to the bottom plates;

step ③, assisting fish to enter an upper stage of fishway unit in turn by other stages of fishway units according to the processes of step ① and step ② until the fish swims upstream successfully;

step ④, enabling the fish repelling system to continue to move forwards and the migratory fish enters a last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position; after the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating; and step ⑤, completing all the above steps to finish a fish passage cycle; and with a cooperative work of a plurality of fish repelling systems, all stages of fishway units assist migratory fish to swim upstream step by step according to the corresponding steps.

16. A fish passage method of the step-by-step paired and up-down reciprocating combined fishway according to claim 8, comprising steps as follows:

step ①, controlling an operating state of the whole fishway by a control system during a fish migration season, driving a transmission shaft and eccentric wheels by a motor to rotate, and meanwhile enabling sliders fixed to both sides of an inlet of a second-stage fishway unit and sliding slots fixed to both sides of an outlet of a first-stage fishway unit to slide against each other, and enabling roller rows horizontally fixed at the inlet of the second-stage fishway unit and partition plates vertically fixed on bottom plate at the outlet of the first-stage fishway unit to roll against each other, wherein a sliding between the sliders and the sliding slots and a rolling between the roller rows and the partition plates can not only reduce friction, but also prevent water leakage between the two stages of fishway units; the first-stage fishway unit operates to a highest position, the second-stage fishway unit operates to a lowest position, the bottom plates of the two stages of fishway units are flush with each other, and a water flow changes from original free fall to a flat slope open channel water flow, and a flow velocity decreases;

step ②, controlling a fish repelling system by the control system to start to move upstream along the gear belts during performing step ①, repelling migratory fish in the fishway units by a fish repelling net and a net pocket to assist the migratory fish to swim upstream, wherein a bottom of the net pocket is proximate to the bottom plates, and the fish repelling net is in a stretching state under gravity action of the net pocket; the bottom plates of the first-stage fishway unit is flush with the bottom plates of the second-stage fishway unit, the gear belts in the first-stage fishway unit is also flush with the gear belts of the second-stage fishway unit, gears at both ends of the driving device in the fish repelling system enter the second-stage fishway unit from the first-stage fishway unit along the gear belts, and meanwhile, the reel starts to rotate clockwise under control of the control system so as to make the fish repelling net start to contract and move upward, and at the same time the fish repelling net brings the net pocket to move upward, so that the net pocket assists some fish which are unsuccessful to swim upstream to migrate; and the fish repelling net and the net pocket enter the second-stage fishway unit, the reel starts to rotate counterclockwise under the control of the control system, and the fish repelling net and the net pocket descend to a height where the net pocket is proximate to the bottom plates;

step ③, assisting fish to enter an upper stage of fishway unit in turn by other stages of fishway units according to the processes of step ① and step ② until the fish swims upstream successfully;

step ④, enabling the fish repelling system to continue to move forwards and the migratory fish enters a last stage of fishway unit, and enabling the fish repelling system to stop operating when the fish repelling system arrives at an exit of the fishway, and meanwhile enabling the reel to start to rotate clockwise until the fish repelling net is completely retracted; after the fish repelling net is completely retracted, controlling the telescopic rod by the control system to extend downwards, and after the grapple grasps the fish repelling system, controlling the telescopic rod by the control system to start to retract and move upward; controlling the driving wheel by the control system to start to rotate, wherein the driving wheel drives the cable to move downwards, the cable brings the cable clamp to move downstream until the fish repelling system is conveyed to an entrance of the fishway, the driving wheel stops rotating, the telescopic rod starts to move downwards to an appropriate height, the grapple is opened to place the fish repelling system in an initial position; after the fish repelling system is placed in the initial position, the reel starts to rotate counterclockwise to lower the fish repelling net and the net pocket until reaching an initial state; and meanwhile, the driving wheel starts to rotate under the control of the control system, so as to drive the cable and the cable clamp to move until the cable clamp reaches the upstream exit of the fishway, and the driving wheel stops rotating; and step ⑤, completing all the above steps to finish a fish passage cycle; and with a cooperative work of a plurality of fish repelling systems, all stages of fishway units assist migratory fish to swim upstream step by step according to the corresponding steps.

* * * * *